United States Patent [19]

Klahr et al.

[11] 4,412,933

[45] Nov. 1, 1983

[54] COLOR STABILIZED NONIONIC SURFACTANTS

[75] Inventors: Erhard Klahr; Wolfgang Trieselt; Wolf-Dieter Balzer, all of Ludwigshafen; Rainer Strickler, Heidelberg; Dieter Stoeckigt, Ludwigshafen, all of Fed. Rep. of Germany

[73] Assignee: BASF Aktiengesellschaft, Rheinland-Pfalz, Fed. Rep. of Germany

[21] Appl. No.: 255,166

[22] Filed: Apr. 17, 1981

[30] Foreign Application Priority Data

May 16, 1980 [DE] Fed. Rep. of Germany ..... 3018714

[51] Int. Cl.[3] ..... C11D 17/00

[52] U.S. Cl. ..... 252/174.19; 252/174.21; 252/135; 252/356; 252/351

[58] Field of Search ..... 252/356, 351, 135, 407, 252/DIG. 1, DIG. 14, 548, 94, 174.19, 174.21

[56] References Cited

U.S. PATENT DOCUMENTS 4,092,273 5/1978 Inamorato et al. ..... 252/548

*Primary Examiner*—Josephine Barr

*Attorney, Agent, or Firm*—Oblon, Fisher, Spivak, McClelland & Maier

[57] ABSTRACT

Color-stabilized nonionic surfactants which contain chemically bonded polyalkylene oxide groups having terminal hydroxyl groups, and in which are dissolved $C_4$–$C_8$-aliphatic dicarboxylic acids, their $C_1$–$C_4$-alkyl esters or mixtures thereof, as color stabilizers.

4 Claims, No Drawings

COLOR STABILIZED NONIONIC SURFACTANTS

The present invention relates to nonionic surfactants based on polyalkylene oxides or on oxyalkylation products of hydrophobic compounds containing OH or NH groups, in which surfactants none or at most some of the terminal hydroxyl groups are blocked, the products being stabilized against decoloration, caused by decomposition, through the incorporation of a small amount of certain dicarboxylic acids or mixtures thereof or their esters or mixtures thereof, and to the use of such color-stabilized nonionic surfactants in alkaline detergents and cleaning agents.

The principal constituents in detergent and cleaning agent formulations for cleaning processes entailing intense mechanical agitation, for example for bottlewashing or for use in domestic dishwashers, are alkaline builders, such as phosphates, silicates, carbonates and even caustic alkalis. An important and necessary constituent of such cleaning agent formulations (in addition to possible further additives, especially oxidizing agents and disinfectants) is a nonionic surfactant chosen from the conventional categories, amongst which the most important are: alkylene oxide copolymers and block copolymers, and oxyalkylated ethylenepolyamines, propylenepolyamines and fatty alcohols, the alkylene oxide component consisting either of pure ethylene oxide or pure propylene oxide or of both, and the polyaddition, in the last-mentioned case, being carried out with a gaseous mixture of the alkylene oxides or with the oxides used successively (to give a block product).

The surfactants employed are often of a type which, in spite of a good cleaning action, is low-foaming or even has an anti-foam effect; however, certain specific problems may also demand strongly foaming surfactants.

At times, discolorations are encountered, depending on the composition of the cleaning agent or depending on the temperatures to which the latter is exposed. These discolorations (mostly brown) are attributable to chemical reactions between the nonionic surfactant, the alkali and an oxidizing substance, such as atmospheric oxygen or a chlorine donor in the actual cleaning agent formulation. It is true that the color changes may only be of an external nature and may not affect the use characteristics of the product. However, in the case of commercial products, principally for domestic use, an unattractive appearance is a sales obstacle. Furthermore, the interaction between the surfactant, alkali and oxidizing agent may be sufficiently far-reaching that changes in the use characteristics result. It has been found that the free hydroxyl groups of the nonionic surfactants are the point at which the alkali and oxidizing agent attack. For this reason, there has been no lack of endeavors to convert the surfactants to alkali-stable derivatives by blocking the hydroxyl group. Important examples include etherification, for example with benzyl chloride, and acetalization. These operations give nonionic surfactants which have blocked end groups and are sufficiently stable. However, blocking the end groups also causes a change in the physico-chemical properties. For example, the cloud point is lowered and the solubility in water is reduced. From an economic point of view, it is to be noted that the above chemical reactions, which give nonionic surfactants with blocked end groups, are not simple to carry out and therefore add significantly to the cost of the products. Furthermore, blocking the end groups reduces the biodegradability of such surfactants. This may reach the point where legally prescribed minimum degradation rates are no longer achieved.

It is an object of the present invention to provide nonionic low-foaming surfactants which, whilst having otherwise unchanged use characteristics, are stable to strong alkalis and oxidizing agents, i.e. do not discolor.

We have found that this object is achieved by the incorporation of preferably from 0.1 to 5, especially from 0.5 to 3, % by weight, based on the nonionic surfactant, of certain compounds which are dissolved in the surfactant.

According to the invention, these compounds are aliphatic dicarboxylic acids of 4 to 8 carbon atoms, mixtures of these, their $C_1$–$C_4$-alkyl esters, or mixtures of these. Specific examples are succinic acid, glutaric acid and adipic acid, their methyl esters, and especially a ternary mixture of the above three dicarboxylic acids.

The color stabilizers are dissolved in the liquid nonionic surfactant by stirring, advantageously with heating.

Preferably, from 0.1 to 5% by weight, based on surfactant, of the stabilizer is added. Less than 0.1% by weight is insufficiently effective, and more than 5% by weight produces no additional advantages. Industrially, the addition of from 0.5 to 3% by weight is of particular interest.

If the nonionic surfactant is not liquid at room temperature, it is fused, after which the procedure described is followed. When the color stabilizer has dissolved, the surfactant is allowed to solidify again. Accordingly, the surfactants color-stabilized according to the invention can be liquids or solids.

To prepare the cleaning agent formulations, the color-stabilized surfactants are mixed—exactly like the non-color-stabilized surfactants used hitherto—with the other components, especially the alkaline builders mentioned at the outset, with or without further additives such as oxidizing agents, fragrance materials, dyes and disinfectants. In contrast to the case of the non-color-stabilized mixtures there is, with the mixtures according to the invention, virtually no danger of noticeable discoloration on storage, even at elevated temperatures. We have found that the color stabilizers are effective in virtually all ethylene oxide-based ethylene oxide/propylene oxide-based surfactants, i.e. it is not necessary to conduct time-consuming experiments in order to select special surfactants.

Cleaning agent formulations which contain the surfactants color-stabilized according to the invention in general contain from 70 to 99, preferably from 90 to 99, % by weight of inorganic alkaline builder and from 30 to 1, preferably from 10 to 1, % by weight of surfactant, the percentages being based on total formulation.

The Examples which follow illustrate the invention. Percentages are by weight.

EXAMPLES

The alkylene oxide adducts were tested by storing them for 24 days, with and without added stabilizer, at various temperatures.

The samples at room temperature (RT) were stored with and without added NaOH; samples stored at 70° C. all contained solid sodium hydroxide. After the stated time, the iodine color number and color of the sodium hydroxide were determined.

In the Table which follows, the first 3 vertical columns show the iodine color numbers and the last two show a visual rating of the solid sodium hydroxide.

The ratings employed were from 1 (very good, no brown deposit) to 5 (very poor, thick brown deposit). The Table clearly shows the substantially improved color stability of the surfactants containing the additives according to the invention, compared to that of the unstabilized surfactants.

| | Assessment after 24 days | | | | |
|---|---|---|---|---|---|
| | Liquid (iodine color number) | | | Solid NaOH (rating) with NaOH | |
| | without NaOH | with NaOH | | | |
| Example | RT[x] | RT | 70° C. | RT | 70° C. |
| Tallow alcohol - $(EO)_5(PO)_7$[xx] | | | | | |
| No additive | 0.1 | 0.4 | 4.0 | 3 | 5 |
| Dicarboxylic acid mixture | 0.1 | 0.5 | 0.2 | 1 | 2 |
| Succinic acid | 0.1 | 0.1 | 0.4 | 3 | 4 |
| Glutaric acid | 0.1 | 0.1 | 0.2 | 2 | 3 |
| Adipic acid | 0.1 | 0.2 | 0.2 | 3 | 5 |
| Dicarboxylic acid dimethyl ester mixture | 0.1 | 0.2 | 0.3 | 2 | 4 |
| $C_{13/15}$ oxo-alcohol - $(EO)_8$ | | | | | |
| Without additive | 0.1 | 2.6 | 100.0 | 5 | 5 |
| Dicarboxylic acid mixture | 0.1 | 0.1 | 0.2 | 1 | 3 |
| Succinic acid | 0.1 | 0.3 | 0.3 | 3 | 4 |
| Glutaric acid | 0.1 | 0.3 | 0.2 | 2 | 4 |

-continued

| | Assessment after 24 days | | | | |
|---|---|---|---|---|---|
| | Liquid (iodine color number) | | | Solid NaOH (rating) with NaOH | |
| | without NaOH | with NaOH | | | |
| Example | RT[x] | RT | 70° C. | RT | 70° C. |
| Adipic acid | 0.1 | 0.3 | 0.2 | 3 | 4 |
| Dicarboyxlic acid dimethyl ester mixture | 0.1 | 0.3 | 0.3 | 3 | 4 |

[x]Room temperature (20° C.)
[xx]EO = ethylene oxide
PO = propylene oxide

We claim:

1. A color-stabilized nonionic surfactant composition consisting of a nonionic surfactant which contains chemically bonded polyalkylene oxide groups having terminal hydroxyl groups and in which is dissolved 0.1 to 5% by weight of a color stabilizing additive selected from the group consisting of $C_1$–$C_4$ alkyl esters of $C_4$–$C_8$ alkyl dicarboxylic acids, mixtures thereof, and a mixture of $C_4$–$C_8$ alkyl dicarboxylic acids.

2. The color-stabilized nonionic surfactant of claim 1 wherein the color stabilizing additive is a $C_1$–$C_4$ alkyl ester of a $C_4$–$C_8$ alkyl dicarboxylic acid.

3. Cleaning agent formulation consisting essentially of from 70 to 99% by weight of inorganic alkaline builder and from 30 to 1% by weight of nonionic surfactant containing chemically bonded polyalkylene oxide groups having terminal hydroxyl groups, said surfactant containing dissolved 0.1 to 5%, based on nonionic surfactant, of $C_4$–$C_8$-aliphatic dicarboxylic acids, their $C_1$–$C_4$-alkyl esters or mixtures thereof, as color stabilizers.

4. Cleaning agent formulation as claimed in claim 3 wherein the surfactant contains a mixture of succinic acid, glutaric acid and adipic acid, or a mixture of the corresponding methyl esters.

* * * * *